United States Patent [19]

Moyer

[11] 4,014,045

[45] Mar. 29, 1977

[54] WORKMAN'S BREAK-AWAY SAFETY APRON

[76] Inventor: Joseph R. Moyer, 80 Allen Drive, Wayne, N.J. 07470

[22] Filed: Jan. 19, 1976

[21] Appl. No.: 650,266

[52] U.S. Cl. ..... 2/51

[51] Int. Cl.[2] ..... A41D 13/04

[58] Field of Search ..... 2/51, 52

[56] References Cited

UNITED STATES PATENTS

| | | | |
|---|---|---|---|
| 2,423,002 | 6/1947 | Bray | 2/51 X |
| 3,191,186 | 6/1965 | Robertson | 2/51 |
| 3,438,062 | 4/1969 | Dobell | 2/247 |

*Primary Examiner*—Alfred R. Guest
*Attorney, Agent, or Firm*—Joel Halpern

[57] ABSTRACT

A workman's break-away safety apron has a body portion provided at four intersecting edges with segments of fabric pressure fastening material. A neck band has segments of fabric pressure fastening material at the opposed ends thereof. A waist band is formed in two pieces one of which has a segment of fabric pressure fastening material at one end and a plurality of button holes at the other end and the other piece has a segment of fabric pressure fastening material at one end and at least one button at the other end. The segments of pressure fastening material on the neck band and waist band elements are cooperable with the segments on the body portion and thus detachably secure the neck and waist bands to the body of the apron.

4 Claims, 3 Drawing Figures

WORKMAN'S BREAK-AWAY SAFETY APRON

BACKGROUND OF THE INVENTION

The present invention relates to a workman's apron and more paticularly to a workman's safety apron which can be readily detached from the workman in an emergency.

A workman's safety apron designed to be yieldably fastened to the workman so that it can be quickly freed from the workman in the event the apron becomes entangled in machinery was known heretofore. U.S. Pat. No. 3,191,186 issued June 29, 1965 to C. W. Robertson discloses such an apron in which flap elements integral with the body of the apron are adapted to be tucked between the workman's shirt and pants and a button hole connected with a button on the workman's shirt.

Such prior constuctions have not been altogether satisfactory because the apron itself remained in a unitary state and, depending upon the manner of entanglement, it was not always possible to readily separate the workman form the apron. This was particularly true when the apron was constructed of a strong durable material as is generally the case. Thus, either there was danger of the workman being drawn into the machinery with the consequent possibility of serious injury or the lesser consequence of damage to the apron when the material is of lesser quality.

SUMMARY OF THE INVENTION

It is a principal object of this invention to provide a workman's safety apron which is strong and durable and which will nevertheless readily detach itself from the workman in the event it becomes entangled in moving elements of machinery.

It is another object of the invention to provide a workman's safety apron which is readily detachable from the workman in an emergency without damage to the apron.

Other objects and advantages of the invention will become readily apparent from the following description of the invention.

In accordance with the present invention there is provided a workman's break-away safety apron comprising in combination:

an elongated body including a lower section defined by a lower laterally-extending edge, a pair of longitudinally extending side edges and laterally-extending medial edges extending inwardly from said side edges, and an upper section having a central area constituting a continuation of the lower section and the periphery defined by side edges which extend upwardly from the inner termini of said medial edges and a laterally-extending upper edge connecting the tops of the side edges of said upper section;

a segment of pressure fastening material secured to said lower section at each of the junctures of the medial edges and the side edges thereof;

a segment of pressure fastening material secured to said upper section at each of the junctures of said upper edge and the side edges thereof;

a neck band formed of a strip of flexible material having a segment of pressure fastening material secured to each end thereof and detachably connected to the corresponding segments of pressure fastening material on the said upper section of the apron body;

and a two-piece waist band including a first strip of flexible material having a segment of pressure fastening material at one end thereof and a plurality of first non-pressure fastening means on the other end thereof and a second strip of flexible material having a segment of pressure fastening material at one end thereof and at least one second non-pressure fastening means cooperable with said first fastening means on the other end thereof, said first and second strips being detachably connected to the corresponding segments of pressure fastening material on the said lower section of the apron body.

BRIEF DESCRIPTION OF THE DRAWINGS

In order that the invention may be more fully understood it will now be described, by way of example, with reference to the accompanying drawings in which.

DETAILED DESCRIPTION OF THE INVENTION

Figure 1:
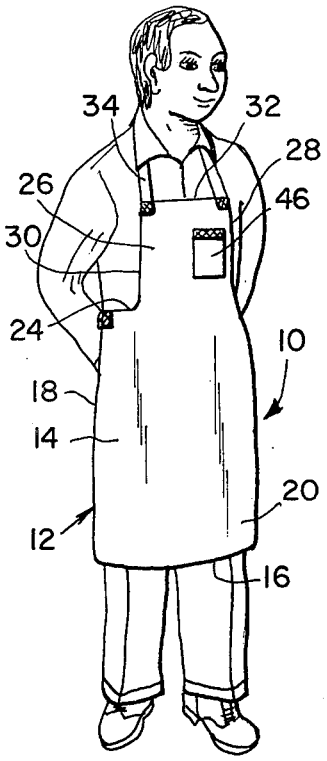
FIG. 1 is an illustration of a workman wearing an apron embodying the present invention.
Figure 2:
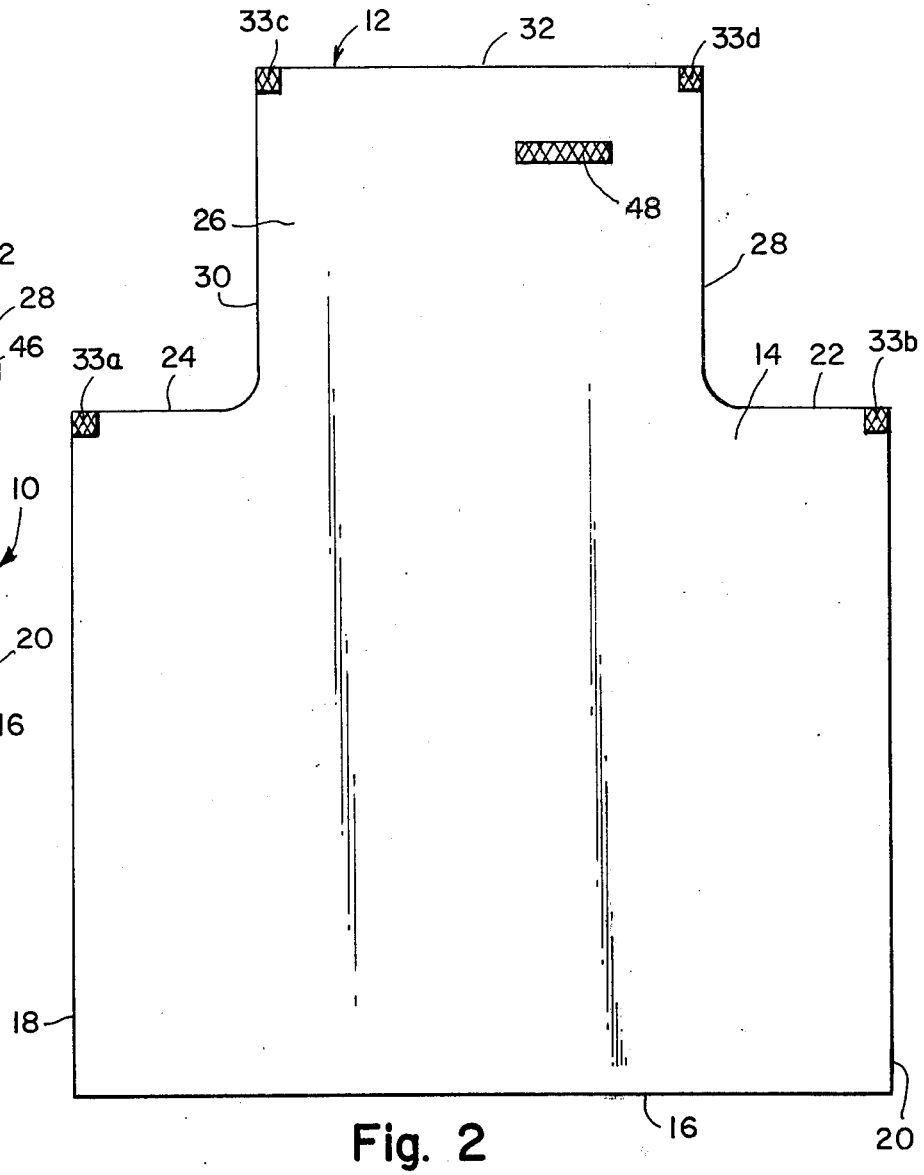
FIG. 2 is a plan view of the body portion of the apron shown in FIG. 1.
Figure 3:
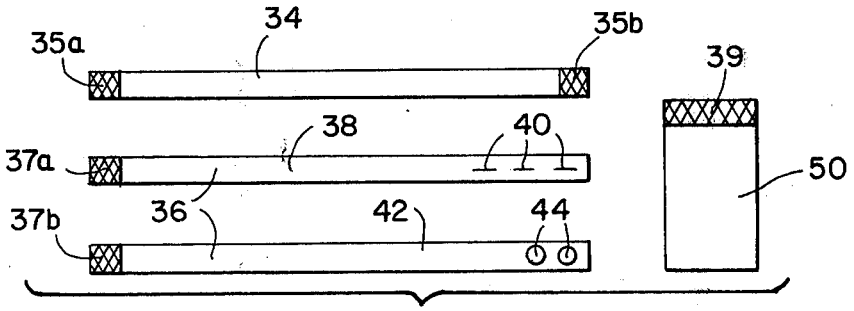
FIG. 3 is a plan view of separable components of the apron shown in FIG. 1.

Referring to FIG. 1 of the drawings there is shown a safety apron 10 of the break-away type specially constructed so as to detach from the workman wearing the same in the event that part of the apron becomes entangled in a moving machine element. The apron includes an elongated body portion indicated generally at 12. The body portion has a lower section 14 formed by a lower laterally-extending edge 16, a pair of longitudinally-extending side edges 18, 20 and laterally-extending medial edges 22, 24 which extend inwardly from the opposed side edges 18, 20 respectively. The body portion also comprises an upper section 26 of lesser lateral and longitudinal dimensions than that of the lower section. The central area of the upper section constitutes a continuation of the lower section whereas the side edges 28, 30 of the upper section extend longitudinally and upwardly from the inner termini of the aforesaid medial edges. An upper edge 32 extends laterally between the tops of side edges 28, 30.

The body portion 12 is given at each of the junctures of the medial edges and side edges 18, 20 and at the junctures of side edges 28, 30 with upper edge 32 a segment 33*a, b, c, d* of a fabric pressure fastening material. Such segments are cooperable with mating segments of like fabric pressure fastening material as will be described.

A neck band 34 is provided for detachable connection with the upper section of the body. The neck band is formed of a strip of flexible material and is provided at each end thereof with a segment of a fabric pressure fastening material 35*a, b* cooperable with the segments located on the upper section of body portion 12.

A two-piece waist band 36 is provided which includes a first strip 38 of flexible material having a segment of fabric pressure fastening material 37*a* at one end thereof and fastening means 40, preferably a plurality of button holes, on the other end thereof. A second strip of flexible material 42 has a segment of fabric pressure fastening material 37*b* at one end thereof and at least one fastening element 44, preferably at least one button, on the other end thereof. It will thus be understood that the segment of fabric pressure fastening material on each strip comprising the waist band should be cooperable with the segments on the lower section of the apron body 12 so as to be detachably connectable to the body.

A micrometer swing pocket 46 is desirably provided by securing an elongated strip 48 of fabric pressure fastening material to the apron body in the upper section thereof and by providing a pocket patch 50 having a cooperable segment of fabric pressure fastening material 39 at the upper marginal portion thereof.

The cooperative pressure fastening elements are well known and are of the type in which one component is a female member whereas the other component is a male member adapted to engage and be retained by the female component. Generally the female components or strips comprise a backing having a plurality of outwardly extending fiber or filament loops originating in the backing layer. The male component includes a backing layer and a plurality of relatively stiff fiber-like outwardly extending elements which may be in the form of rods or hooks. The elements of the male component are adapted to engage and be retained by the loops of the female component and yet may be pulled free of such loops. Typical pressure fastening members are known as "velcro"fasteners and are widely available commercially.

From the foregoing it will be seen that a workman's safety apron has been provided which is readily separable in the event that a portion thereof becomes entangled in a moving element of a machine. Nevertheless the apron may be constructed of a sturdy durable fabric such as denim. The apron of the invention thus represents an improvement in aprons of the character described in offering quick and ready releasability from the machine element in which it may become entangled and durability. The provision of a two piece waist band enables the workman to adjust the fit of the apron at the waist line of his individual dimensions thereby affording greater comfort and avoiding the creation of a loose fit which presents excess material in the area adjacent the machine, thus reducing somewhat the risk of entanglement in the machine.

I claim:

1. A workman's break-away safety apron comprising in combination:

an elongated body including a lower section defined by a lower laterally-extending edge, a pair of longitudinally extending side edges and laterally-extending medial edges extending inwardly from said side edges, and an upper section having a central area constituting a continuation of the lower section and the periphery defined by side edges which extend upwardly from the inner termini of said medial edges and a laterally-extending upper edge connecting the tops of the side edges of said upper section;

a segment of non-metallic pressure fastening material secured to said lower section at each of the junctures of the medial edges and the side edges thereof;

a segment of non-metallic pressure fastening material secured to said upper section at each of the junctures of said upper edge and the side edges thereof;

a neck band formed of a strip of flexible material having a segment of non-metallic pressure fastening material secured to each end thereof and detachably connected to the corresponding segments of non-metallic pressure fastening material on the said upper section of the apron body;

and a two-piece waist band including a first strip of flexible material having a segment of non-metallic pressure fastening material at one end thereof and a plurality of first nonpressure fastening means on the other end thereof and a second strip of flexible material having a segment of non-metallic pressure fastening material at one end thereof and at least one second non-pressure fastening means cooperable with said first fastening means on the other end of said first strip, said first and second strips being detachably connected to the corresponding segments of non-metallic pressure fastening material on the said lower section of the apron body.

2. An apron according to claim 1, wherein an elongated strip of non-metallic pressure fastening material is secured to said upper section of the apron body and a micrometer swing pocket having a cooperable strip of non-metallic fastening material is detachably connected thereto.

3. An apron according to claim 1, wherein said first and second non-pressure fastening means comprise button holes and buttons.

4. An apron according to claim 1, wherein said segments of non-metallic pressure fastening material comprise cooperable "velcro"segments.

* * * * *